United States Patent [19]

Götz et al.

[11] Patent Number: 4,618,273

[45] Date of Patent: Oct. 21, 1986

[54] STEP BEARING FOR A SPINNING ROTOR SHAFT

[75] Inventors: Dieter Götz, Geislingen; Werner Zott, Donzdorf, both of Fed. Rep. of Germany

[73] Assignees: Fritz Stahlecker; Hans Stahlecker, both of Fed. Rep. of Germany

[21] Appl. No.: 796,792

[22] Filed: Nov. 12, 1985

[30] Foreign Application Priority Data

Nov. 9, 1984 [DE] Fed. Rep. of Germany ..... 3440950

[51] Int. Cl.[4] ..... F16C 19/50

[52] U.S. Cl. ..... 384/606; 384/610

[58] Field of Search ..... 384/606, 610, 149, 213, 384/607

[56] References Cited

U.S. PATENT DOCUMENTS

| | | | |
|---|---|---|---|
| 1,375,376 | 4/1921 | Fynn | 384/149 |
| 1,942,077 | 1/1934 | Warren | 384/610 |
| 2,752,209 | 6/1956 | Acterman et al. | 384/606 |
| 4,106,192 | 8/1978 | Stahlecker | 384/610 |

*Primary Examiner*—Lenard A. Footland

*Attorney, Agent, or Firm*—Barnes & Thornburg

[57] ABSTRACT

In the case of a step bearing for an essentially horizontally arranged shaft of an open-end spinning rotor that supports itself against a freely rotatable ball, a housing is provided that contains a lubricant supply means by means of which the ball is supplied with lubricating grease.

26 Claims, 4 Drawing Figures

STEP BEARING FOR A SPINNING ROTOR SHAFT

BACKGROUND AND SUMMARY OF THE INVENTION

This invention relates to a step bearing for a shaft of an essentially horizontally arranged spinning rotor, the shaft of which is loaded by an axial force and with its end is supported against a freely rotatable ball that is guided on the side opposite to the shaft by means of a guiding element. The step bearing has a housing containing a lubricant supply means, the shaft of the spinning rotor being introduced into said housing through a bore.

In the case of a known step bearing of the above-mentioned type shown as described in German published unexamined Patent Application (DE-OS) 25 14 734, the shaft of the spinning rotor is supported radially by means of pairs of supporting disks. By a slight slanting of the axes of the supporting disks, an axial force is exercised on the shaft, by means of which this shaft supports itself against the freely rotatable ball. Below the ball, a lubricant bath for a lubricating oil is provided into which a wick immerses that is placed over the ball. By means of the wick, lubricating oil is absorbed and transported to the ball. This step bearing has proven itself very well in practical operation. It was found, however, that there is sometimes the danger that oil emerges through the bore through which the shaft of the spinning rotor enters the lubricant housing and reaches the supporting disks and the driving belt. This condition can result in undesirable impairment of the spinning operation.

This invention is based on the objective of developing a step bearing of the above-mentioned type in such a way that the emerging of oil is prevented. This objective is achieved by providing means in order to supply lubricating grease to the ball. This type of grease lubrication securely avoids the problems that may occur through emerging oil.

In an advantageous development of the invention, it is provided that the ball is surrounded by a trough-shaped lubricant container that is filled with lubricating grease. Because of this lubricant container, it is always assured that there is a sufficient amount of lubricating grease available in the direct vicinity of the ball which the ball itself supplies to its supporting surfaces.

In a further development of the invention, it is provided that the lubricant container, is connected with a collecting container through at least one opening. As a result, it is ensured that the lubricating grease exchanges itself automatically in the area of the bearing points of the ball. In order to make available a sufficient amount of lubricating grease for a longer operating period, it is provided in advantageous embodiments of the invention that the lubricant container forms the bottom of a lubricant supply arrangement. In the case of another embodiment, it is provided that the lubricant supply system is connected with the area of the lubricant container through a connecting line.

Other objects, advantages and novel features of the present invention will become apparent from the following detailed description of the invention when considered in conjunction with the accompanying drawings.

DETAILED DESCRIPTION OF DRAWINGS

Figure 1:
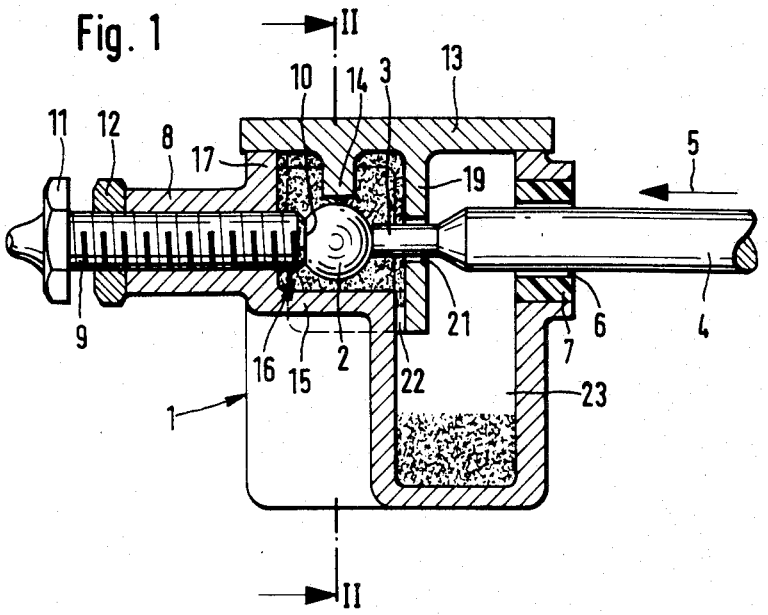
FIG. 1 is an axial schematic sectional view through a step bearing constructed according to a preferred embodiment of the invention.

FIG. 1 shows only the end area of shaft 4 of a spinning rotor. The shaft 4, in a manner that is now shown in detail, is disposed in a bearing which absorbs only radial supporting forces for the shaft 4. In particular, this is a so-called supporting disk bearing arrangement having four supporting disks arranged in pairs of disks forming a wedge-shaped gap in which the shaft 4 is located. For example, such a supporting disk bearing arrangement is used in commercially available open-end rotor spinning machines manufactured by Schlafhorst of Germany. By suitable means, in particular, by a slight slanting of the axes of these pairs of supporting disks, an axial force is exercised in the direction of the Arrow 5 toward the end 3 of the shaft 4. The shaft 4 supports itself against a ball 2 with one of its ends 3 having a small diameter. Diametrically opposite the shaft 4, a bolt 9 is provided which, by means of a spherically-shaped receiving surface 10, guides the ball 2 in transverse direction. The ball 2 is disposed in a lubricant container housing that is equipped with a sleeve-type projection 8 having an internal thread into which the bolt 9 having an external thread is screwed. The bolt 9 which is subsequently secured by a check nut 12 has a head 11 by which its axial position is adjusted.

Figure 2:
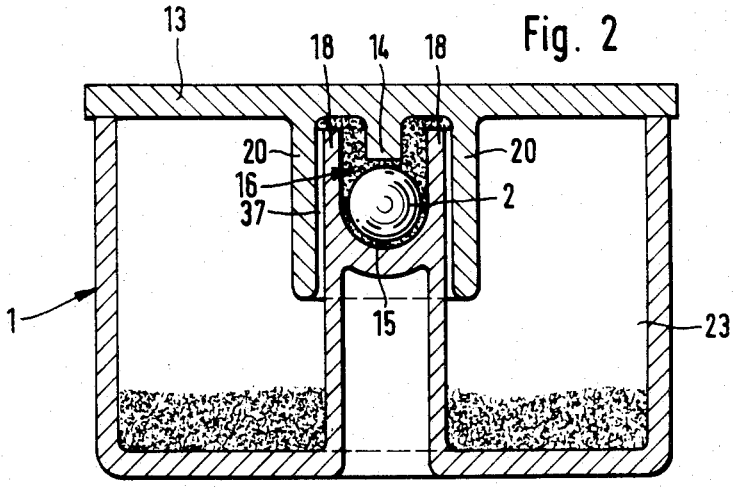
FIG. 2 is a sectional view taken along Line II—II of FIG. 1.

The ball 2 is surrounded by a lubricant container 15 (FIG. 2) extending in longitudinal direction from near the end 3 of the shaft 4 toward the bolt 9. The lubricant container 15 has an approximately semi-cylindrical cross-sectional shape as depicted in FIG. 2. The distance between the lubricant container 15 and the ball 2 is about 2 mm (gap between ball and closest parts of walls of container 15—See FIG. 2). In the axial direction, the lubricant container 15 is limited by an end wall 17 from which the bolt 9 projects. The other end is limited by a separating wall 19 which is a component of a cover 13 which seals the housing 1. Laterally, the lubricant container 15 is limited by two lateral walls 18 which extend approximately the level of the cover 13. The cover 13 also has a projection 14 directed in the direction of the ball 2, this projection 14 being opposite the ball 2. When the shaft 4 is pulled off, the position of the ball 2 is secured in such a way by the internal dimension of the walls defining the space for the ball 2 in such a way that it remains in the area of the spherically-shaped guide 10 in such a way that, when the shaft 4 is reinserted, the ball 2 is pressed into the shown operating position.

The lubricant container 15 with the lateral walls 18, the end wall 17 and the separating wall 19 form a lubricant supply system 16 that is filled with lubricating grease. With its end 3 having the smaller diameter, the shaft 4 penetrates into this lubricant supply system 16 through a passage bore 21 of the separating wall 19. In front of the separating wall 19, a lubricant collecting container 23 is formed in the housing 1, opposite which the lubricant supply system 16 is arranged in an elevated manner. The collecting container 23 that is formed by the same housing 1 also has an opening 6 through which the shaft 4 is guided. A contactless sealing device is inserted into this passage bore 21, this sealing device advantageously being comprised of a material that permits free running of the shaft 4. The passage bore 21 of the separating wall 19 is clearly smaller than the passage bore 6 or the ring gap formed by the sealing ring 7.

The separating wall 19 which projects from the cover 13 has two lateral extensions 20 by means of which it reaches around the lateral walls 18 while forming sealing gaps 37. The separating wall 19 connects to these lateral extensions 20 at a distance at least in the area of the bottom of the lubricant container 15 so that a gap 22 remains that is used as a connecting opening to the collecting container 23. The gap 22 is dimensioned to be relatively narrow, i.e., of a magnitude of one to maximally 2 mm, so that lubricating grease can flow off from the lubricant supply system 16 into the collecting container 23, but that no excessive amount of lubricating grease is used up.

The filling of lubricating grease into the lubricant supply system 6 preferably takes place at the side of the shaft 4. For this purpose, the spinning rotor with the shaft 4 is pulled off so that the passage openings 6 and 21 are accessible. A correspondingly designed lubricating grease press is then introduced to the openings through which lubricating grease is added to the lubricant supply system. As an alternative, it is also contemplated by the invention to construct the bolt 9 to be hollow and to equip it with a lubricating nipple through which a replenishing of lubricating grease takes place.

Figure 3:
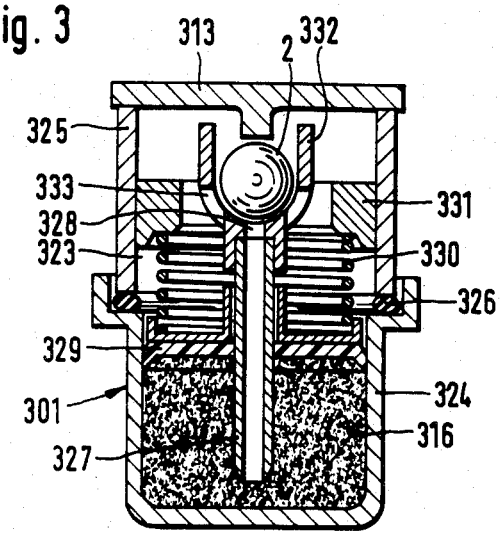
FIG. 3 is a view similar to FIG. 2 showing another embodiment of a step bearing constructed according to the invention and having a lubricant supply system which leads to the ball via an ascending pipe.

In the case of the embodiment according to FIG. 3, which represents a sectional view similar to FIG. 2, the shaft supporting itself on the ball 2 and the diametrically opposite bolt are not visible. It is to be understood that the non-illustrated shaft end 4, opening 6 and seal 7 is to be constructed as described above with respect to FIGS. 1 and 2. Also in the case of this embodiment, the ball 2 is surrounded by a lubricant container 332. This lubricant container 332 is located in a housing 301 that is subdivided horizontally. In the lower part 324 of the housing, a lubricant supply system 316 is located which is connected with the area of the ball 2 via an ascending pipe 327 and a duct 328 provided in the lubricant container 332. The lubricant supply system 316 is covered with a piston-type plate 329 which is disposed about the ascending pipe 327. The plate 329 is loaded by a pressure spring 330, the other end of which supports itself against an edge 331 which is fastened to the upper part 325 of the housing. The upper part 325 of the housing and the lower part 324 of the housing serving as the lubricant supply system 316 are firmly connected with one another upon the insertion of a sealing ring 326. The upper part 325 of the housing is closed by a cover 313. By means of the loading of the lubricant supply system 316 by the spring 330 and the piston-type plate 329, lubricating grease is transported through the ascending pipe 327 to the area of the ball 2. This lubricating grease can flow out of the lubricant container 332 through the openings 333 in this container 332. It will then be collected in the space above the plate 329 that serves as the lubricant collecting container 323.

Figure 4:
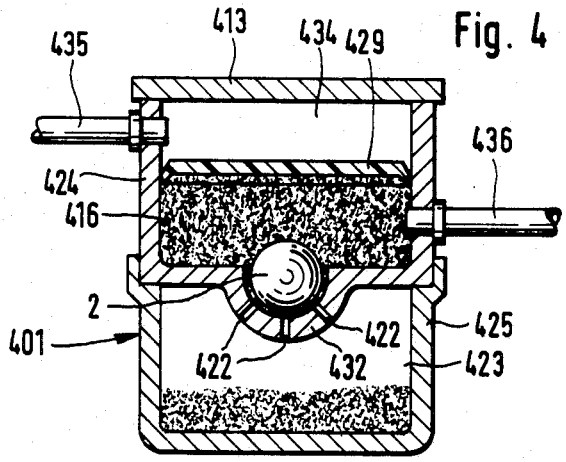
FIG. 4 is a sectional schematic view similar to FIG. 2, showing another embodiment of the invention in which the ball is again directly housed in a lubricant supply system.

The embodiment according to FIG. 4 is also illustrated in a sectional similar to FIG. 2, so that here also, the bolt and the shaft of the spinning rotor are not visible but can be constructed as described above for FIGS. 1 and 2. In the case of this embodiment, a housing 401 is divided by a horizontal plane into a lower part 425 of the housing and an upper part 424 of the housing. The upper part 424 of the housing has a bottom portion in which a lubricant container 432 for the ball 2 is provided. Above this bottom portion, the upper part 424 of the housing forms a lubricant supply system 416 which in upward direction is covered by a plate 429 that is guided like a piston, this plate 429, for example, being made of plastic. The upper part 424 of the housing is then closed by a cover 413. Between the cover 413 and the plate 429, a supply pipe 435 is connected through which compressed air is supplied to the space 434 which then loads the lubricant supply system 416 with a defined pressure. Between the plate 429 and the bottom portion of the upper part 424 of the housing, a connection is provided for a supply pipe 436 through which lubricating grease is supplied to the lubricant supply system 416. This supply pipe 436 is advantageously guided toward the front to the operating side of the spinning unit where it has an easily accessible connection. The lubricant can then be supplied from the operating side of the spinning unit. This may take place, for example, according to especially preferred embodiments of the invention by means of an automatic servicing device which supplies a dosage of lubricating grease at predetermined time intervals. In the area of the lubricant container 432, several openings 422 are provided which lead to the lower part 425 of the housing serving as the collecting container 423. Also in the case of this embodiment, it is ensured that the lubricating grease can flow off to the collecting container 423. The lower part 425 of the housing is detachably fastened at the upper part 424 so that it can simply be taken off and cleaned.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

We claim:

1. A step bearing for supporting a spinning rotor shaft comprising:

a bearing housing means for accommodating an end of a spinning rotor shaft;

a ball means guidable by a guide means and supporting an end of said shaft means, in said housing means;

lubricant supply means for continuously supplying lubricant to said ball means, including a container means for holding lubricant around the circumference of the ball means, wherein said ball means is disposed in said container means, said container means being trough-shaped and filled with lubricating grease.

2. A step bearing according to claim 1, said guiding means including a bolt with a spherically-shaped surface to accommodate the ball means, said bolt being screwed into the rear wall of the chamber serving as the lubricant supply means.

3. A step bearing according to claim 2, further comprising lubricant collecting means and opening means, wherein said opening means connects said container means and said collecting means.

4. A step bearing according to claim 3, wherein said container means is contained by a wall means, one of said wall means having a bore for receiving said shaft and the other of said wall means having a receiving means for said guiding means.

5. A step bearing according to claim 4, wherein the container means forms the bottom of said lubricant supply means.

6. A step bearing according to claim 4, wherein the lubricating supply means, is connected to the area of the container means via a connecting means.

7. A step bearing according to claim 6, wherein the lubricant supply means and the collecting means are developed as separate chambers housed in a joint housing, said chambers being separated by a separating wall.

8. A step bearing according to claim 7, wherein the separating wall projects from a cover that seals the housing.

9. A step bearing according to claim 8, wherein the chamber serving as the lubricant supply means is arranged in an elevated manner in the joint housing with respect to the chamber serving as the collecting means.

10. A step bearing according to claim 9, wherein said trough-shaped container means forms the bottom of the chamber serving as the lubricant supply means.

11. A step bearing according to claim 10, said guiding means including a bolt with a spherically-shaped surface to accommodate the ball means, said bolt being screwed into the rear wall of the chamber serving as the lubricant supply means.

12. A step bearing according to claim 11, wherein the separating wall is equipped with a passage bore for the shaft.

13. A step bearing according to claim 12, wherein the chamber serving as the collecting means is adjacent in axial direction of the shaft to the lubricant supply means, said chamber having a passage bore for the shaft.

14. A step bearing according to claim 13, wherein the separating wall leaves a gap in the area between the chamber serving as the lubricant supply means and the chamber serving as the collecting means.

15. A step bearing according to claim 7, further comprising a multipart housing, wherein said multipart housing is horizontally divided into the lubricant supply means and the lubricant collecting means.

16. A step bearing according to claim 15, wherein the lubricant supply means has a plate, said plate being displaceable by means of a loading means being applied to said plate.

17. A step bearing according to claim 16, wherein the side of the plate that faces away from the lubricant supply means is acted upon by compressed air.

18. A device according to claim 17, wherein a supply pipe for supplying lubricating grease is connected to the lubricant supply means.

19. A step bearing according to claim 18, wherein the container means has opening means leading to the collecting means.

20. A step bearing according to claim 19, wherein the lubricant supply means is arranged below the container means and is connected with it via an ascending pipe.

21. A step bearing according to claim 3, wherein the lubricant supply means and the collecting means are developed as separate chambers housed in a joint housing, said chambers being separated by a separating wall.

22. A step bearing according to claim 21, wherein the chamber serving as the lubricant supply means is arranged in an elevated manner in the joint housing with respect to the chamber serving as the collecting means.

23. A step bearing according to claim 21, wherein the separating wall is equipped with a passage bore for the shaft.

24. A step bearing according to claim 23, wherein the separating wall leaves a gap in the area between the chamber serving as the lubricant supply means and the chamber serving as the collecting means.

25. A step bearing according to claim 3, further comprising a multipart housing, wherein said multipart housing is horizontally divided into the lubricant supply means and the lubricant collecting means.

26. A step bearing according to claim 25, wherein the lubricant supply means has a plate, said plate being displaceable by means of a loading means being applied to said plate.

* * * * *